United States Patent [19]

Narui et al.

[11] Patent Number: 4,764,496

[45] Date of Patent: Aug. 16, 1988

[54] THERMAL TRANSFER RECORDING MEDIUM HAVING AN IMPROVED HOT-STICKING RESISTANCE

[75] Inventors: Hiroshi Narui, Uji; Terumi Shinohara, Joyo; Denichiro Gotoh; Shinya Yamamoto, both of Kyoto, all of Japan

[73] Assignee: Oike Industrial Co., Ltd., Kyoto, Japan

[21] Appl. No.: 932,420

[22] Filed: Nov. 19, 1986

[30] Foreign Application Priority Data

Nov. 20, 1985 [JP] Japan ..... 60-260774

[51] Int. Cl.[4] ..... B41M 5/035; B41M 5/26

[52] U.S. Cl. ..... 503/227; 8/471; 427/256; 428/195; 428/209; 428/333; 428/488.4; 428/698; 428/702; 428/704; 428/913; 428/914

[58] Field of Search ..... 428/195, 209, 484, 488.1, 428/488.4, 913, 914, 333, 698, 702, 704; 503/227; 8/471; 427/256

[56] References Cited

U.S. PATENT DOCUMENTS 4,559,273 12/1985 Kutsukake et al. ..... 8/471

FOREIGN PATENT DOCUMENTS 0138483 4/1985 European Pat. Off. ..... 503/227
0097436 8/1979 Japan ..... 428/488.4
0146790 11/1980 Japan ..... 428/488.4
0051385 5/1981 Japan ..... 503/227
0155993 9/1983 Japan ..... 428/488.4

*Primary Examiner*—Bruce H. Hess
*Attorney, Agent, or Firm*—Armstrong, Nikaido, Marmelstein & Kubovcik

[57] ABSTRACT

A thermal transfer recording medium having an improved hot-sticking resistance which comprises a thermoplastic resin film as a substrate, a thermally transferable ink layer provided on one surface of the film, and a thin layer of an inorganic substance provided on the other surface of the film. The thin layer of the inorganic substance prevents the recording medium from hot-sticking phenomenon, whereby a high speed printing is made possible.

14 Claims, No Drawings

THERMAL TRANSFER RECORDING MEDIUM HAVING AN IMPROVED HOT-STICKING RESISTANCE

BACKGROUND OF THE INVENTION

The present invention relates to a thermal transfer recording medium improved in a hot-sticking resistance.

In a thermal transfer recording system, there is used a recording medium wherein a thermally transferable ink layer such as heat-meltable ink layer or heat-sublimatable ink layer is provided on one surface of a substrate. Print images are produced by bringing the thermally transferable ink layer of the recording medium in contact with a receiving medium such as plain paper while a thermal head is brought in contact with the back surface of the substrate of the recording medium, and selectively activating plural heating elements of the thermal head to heat localized areas of the thermally transferable ink layer, whereby the heat-meltable ink or sublimable dye in the heated areas of the ink layer is transferred onto the receiving medium.

Plastic films including polyethylene terephthalate film as a typical example are used as the substrate of the above-mentioned thermal transfer recording medium.

When a plastic film is used as the substrate, a portion of the plastic film which is in contact with the thermal head is adhered to the thermal head because the surface temperature of the thermal head exceeds the melting temperature of the plastic film during printing operation, whereby feeding of the recording medium is hindered. Such phenomenon is so-called "hot-sticking phenomenon".

In order to prevent such hot-sticking phenomenon, heretofore, a hot-sticking resistant layer composed of a heat resistant resin as a main component was provided on the surface of the plastic film which was brought in contact with the thermal head.

However, such conventional hot-sticking resistant layer has the following drawbacks due to the fact that the layer is a coating of a resin.

That is, in recent years, a high speed printing is also required for thermal transfer recording. The operation temperature of the thermal head must be set to a high temperature to increase the printing speed. However, it is not impossible to adopt a considerably high operation temperature for the thermal head since there is a limit in heat resistance of the conventional hot-sticking resistant layer due to the fact that it is composed of organic substances.

Further, there is a lower limit in thickness of a resin coating to obtain a coating having a uniform thickness. For the reason, the heat conduction of the recording medium is detracted by providing the hot-sticking resistant layer, which causes a disadvantage that unevenness of print images is marked with increasing printing speed.

An object of the present invention is to provide a thermal transfer recording medium improved in hot-sticking resistance which facilitates a high speed printing.

This and other objects of the invention will become apparent from the description hereinafter.

SUMMARY OF THE INVENTION

The present invention provides a thermal transfer recording medium having an improved hot-sticking resistance which comprises a thermoplastic resin film as a substrate, a thermally transferable ink layer provided on one surface of the film and a thin layer of an inorganic substance provided on the other surface of the film.

DETAILED DESCRIPTION

The characteristic of the present invention is that a thin layer of an inorganic substance is used as a hot-sticking resistant layer.

The hot-sticking resistant layer has a high heat resisting temperature due to the fact that it is a layer of an inorganic substance, and the layer is not melted at a high heating temperature of a thermal head required for a high speed printing. Therefore, the use of the thermal transfer recording medium of the present invention makes possible a thermal transfer recording at a high speed.

Further, in the case of a layer of an inorganic substance, an extremely thin and uniform layer is available as illustrated by a metal deposition layer, as compared with a coating of a resin. Therefore, the use of a thin layer of an inorganic substance as a hot-sticking resistant layer does not detract the heat conduction of a thermal transfer recording medium and does not cause unevenness in heat conduction through the recording medium, which ensures the formation of clear print images in high speed printing.

Any inorganic substance can be used for the formation of the thin inorganic layer in the invention without particular limitation, if it has a heat resisting temperature (melting temperature or decomposition temperature) of not less than 300° C. Preferred examples of the inorganic substance include oxides such as SiO, $SiO_2$, $TiO_2$, ZnO and $Al_2O_3$, nitrides such as TiN; carbides such as TiC; carbon; and metals such as Al, Ni, Cr, Ti and Ni-Cr alloy.

The thickness of the inorganic layer is selected so that a good hot-sticking resistance is exhibited without hindering the heat conduction of the substrate. Usually, a thickness between 60 Å and 1,000 Å is adopted. When a thickness of less than 60 Å is adopted, a uniform continuous layer is not available and consequently a good hot-sticking resistance is not obtained. An inorganic layer having a thickness of more than 1,000 Å hinders the heat conduction, which results in difficulty in high speed printing. From this standpoint, a preferred thickness is from 200 to 600 Å.

A suitable method is adopted for the formation of the inorganic layer, depending upon the kind of the inorganic substance used. For example, vacuum-deposition method, sputtering method and ion-plating method are adopted as a general method. A layer of an oxide such as $SiO_2$ or $TiO_2$ can also be formed by a chemical vapor deposition method (CVD) using a halogen compound of Si or Ti. A layer of $TiO_2$ can also be formed by a method wherein an alkyltitanate is applied onto a substrate, followed by hydrolysis of the alkyltitanate.

Any thermoplastic resin film can be used as a substrate without particular limitation. Examples of the film include polyester film, polycarbonate film, polyamide film and polypropylene film. The thickness of the plastic film is usually from 2 to 20 μm. A polyethylene terephthalate film is preferably used.

Any conventional thermally transferable ink layer including a heat-meltable ink layer and heat-sublimable ink layer can be used as a thermally transferable ink layer in the invention without particular limitation. An example of the heat-meltable ink layer is one formed by applying onto a substrate a hot-melt ink wherein a coloring agent such as organic or inorganic pigment, or dye is dispersed in a binder material including a wax such as natural wax and synthetic wax, a thermoplastic resin such as ethylenevinyl acetate copolymer, and a mixture of a wax and a thermoplastic resin. An example of the heat-sublimable ink layer is one formed by applying onto a substrate a sublimable ink wherein a sublimation type dispersed dye such as anthraquinone type dispersed dye or azo type dispersed dye is dispersed in a water-soluble resin such as polyvinyl alcohol and casein.

The present invention is more specifically described and explained by means of the following Examples. It is to be understood that the present invention is not limited to the Examples, and various change and modifications may be made in the invention without departing from the spirit and scope thereof.

EXAMPLE 1

A layer of $SiO_2$ having a thickness of 300 Å is formed on one surface of polyethylene terephthalate film having a thickness of 4 μm by a vacuum-deposition method. A hot-melt ink having the formulation mentioned below was applied in a thickness of 3 μm onto the other surface of the film to give a thermal transfer recording medium.

| Hot-melt ink | |
|---|---|
| Component | % by weight |
| Carnauba wax | 80 |
| Carbon black | 10 |
| Oleic acid | 10 |

EXAMPLE 2

The same procedured as in Example 1 except that a layer of $TiO_2$ having a thickness of 200 Å and formed by applying an alkyltitanate onto the film and hydrolyzing it was used instead of the $SiO_2$ layer were repeated to give a thermal transfer recording medium.

EXAMPLE 3

The same procedures as in Example 1 except that a layer of Al having a thickness of 500 Å and formed by a vacuum-deposition method was used instead of the $SiO_2$ layer were repeated to give a thermal transfer recording medium.

A ribbon is formed from each of the thermal transfer recording media obtained in Examples 1 to 3. Employing each ribbon, a thermal transfer printing onto a plain paper was conducted by means of a thermal transfer printer (MWP-5N made by NEC Corporation, operation temperature of thermal head: 250° C., printing speed: 40 letters/second).

All ribbons did not cause hot-sticking and feeding of each ribbon was carried out smoothly, and clear print images were produced.

In addition to the materials and ingredients used in the Examples, other materials and ingredients can be used in the Examples as set forth in the specification to obtain subtantially the same results.

In the invention, a thin layer of an inorganic substance is used as a hot-sticking resistant layer of a thermal transfer recording medium. For the reason, a high operation temperature is adopted for a thermal head, whereby a high speed printing is made possible.

What we claim is:

1. A thermal transfer recording medium for use in a recording method wherein a thermally transferable ink layer provided on one surface of a substrate is brought into contact with a receiving medium and localized areas of the ink layer are heated selectively by means of a thermal head which is brought into contact with the other surface of the substrate, thereby forming print images on the receiving medium, said recording medium consisting essentially of a thermoplastic resin film as a substrate, a thermally transferable ink layer provided on a first surface of the film and a thin depoisiton layer consisting of an inorganic substance having a melting temperature or decomposition temperature not less than 300° C. and provided directly on a second surface of the film which is to be brought into contact with the thermal head, said inorganic substance being a member selected from the group consisting of oxides, nitrides, carbides and carbon and provided at a thickness of 60 to 1000 Å.

2. The recording medium of claim 1, wherein said oxide is a member selected from the group consisting of SiO, $SiO_2$, ZnO and $Al_2O_3$.

3. The recording medium of claim 1, wherein said nitride is TiN.

4. The recording medium of claim 1, wherein said carbide is TiC.

5. The recording medium of claim 1, wherein said deposition layer is a vacuum-deposition layer of $SiO_2$.

6. The recording medium of claim 1, wherein said deposition layer is a layer of $TiO_2$ formed by hydrolyzing an alkyltitanate.

7. The recording medium of claim 1, wherein the thickness of said deposition layer is from 200 to 1,000 Å.

8. A method for producing print images by using a thermal transfer recording medium which comprises the steps of:

(a) using as a recording medium a thermal transfer recording medium consisting essentially of a thermoplastic resin film as a substrate, a thermally transferable ink layer consisting of an inorganic substance having a melting temperature or decomposition temperature not less than 300° C. and provided directly on a second surface of the film which is to be brought into contact with a thermal head, said inorganic substance being a member selected from the group consisting of oxides, nitrides, carbides and carbon and provided at a thickness of 60 to 1000 Å;

(b) bringing said thermally transferable ink layer of the recording medium into contact with a receiving medium; and (c) heating localized areas of said thermally transferable ink layer by means of said thermal head which is brought into contact with said deposition layer of the recording medium, thereby forming print images on said receiving medium.

9. The method of claim 8, wherein said oxide is a member selected from the group consisting of SiO, $SiO_2$, ZnO and $Al_2O_3$.

10. The method of claim 8, wherein said nitride is TiN.

11. The method of claim 8, wherein said carbide is TiC.

12. The method of claim 8, wherein said deposition layer is a vacuum-deposition layer of $SiO_2$.

13. The method of claim 8, wherein said deposition layer is a layer of $TiO_2$ formed by hydrolyzing an alkyltitanate.

14. The method of claim 8, wherein the thickness of said deposition layer is from 200 to 1,000 Å.

* * * * *